US005771502A

United States Patent [19]

O'Grady

[11] Patent Number: 5,771,502

[45] Date of Patent: Jun. 30, 1998

[54] FLUSH LEVER ASSEMBLY THAT PREVENTS FLUSHING OF THE TOILET UNLESS THE SEAT AND LID ARE IN A LOWERED POSITION

[76] Inventor: James J. O'Grady, 152 St. Andrews La., Glen Cove, N.Y. 11542

[21] Appl. No.: 677,356

[22] Filed: Jul. 5, 1996

[51] Int. Cl.[6] ..... E03D 5/09

[52] U.S. Cl. ..... 4/405; 4/249

[58] Field of Search ..... 4/405, 411, 412, 4/413, 414, 234, 242.1, 249, 250

[56] References Cited

U.S. PATENT DOCUMENTS

| | | | |
|---|---|---|---|
| 941,895 | 11/1909 | Straw | 4/250 |
| 1,066,863 | 7/1913 | Theleen | 4/405 |
| 1,224,734 | 5/1917 | Gallagher | 4/330 |
| 1,638,161 | 8/1927 | Kirk | 4/414 |
| 1,803,958 | 5/1931 | Cadwell et al. | 4/250 |
| 2,755,483 | 7/1956 | Krucki | 4/405 |
| 3,780,384 | 12/1973 | Rivelle | 4/41 |
| 4,512,046 | 4/1985 | Riggle | 4/661 |
| 4,519,105 | 5/1985 | Blanck | 4/661 |
| 4,573,223 | 3/1986 | Schmidt | 4/408 |
| 4,831,670 | 5/1989 | Valasquez | 4/408 |
| 4,839,928 | 6/1989 | Probasco | 4/251 |
| 4,974,263 | 12/1990 | Sheppard et al. | 4/250 |
| 5,003,643 | 4/1991 | Chung | 4/313 |
| 5,054,132 | 10/1991 | Bartella | 4/302 |
| 5,177,818 | 1/1993 | Tsai | 4/241 |
| 5,349,703 | 9/1994 | Mocilnikar et al. | 4/250 |
| 5,400,445 | 3/1995 | Hull | 4/405 |
| 5,400,446 | 3/1995 | Bloemer et al. | 4/408 |
| 5,435,016 | 7/1995 | Smith et al. | 4/234 |
| 5,491,848 | 2/1996 | Wang | 4/405 |
| 5,502,847 | 4/1996 | Weeks | 4/411 |

*Primary Examiner*—Charles R. Eloshway

*Attorney, Agent, or Firm*—Fitzpatrick, Cella, Harper & Scinto

[57] ABSTRACT

A flush lever assembly for use in a toilet having a main body, a seat, a closure lid movable between a first position in which the seat is covered and a second position in which the seat is not covered, and a drainage mechanism, comprises: a bolt for engaging the main body; and a flush lever having a flush arm portion and an insertion portion to be inserted into the bolt to lockingly engage the flush lever to the drainage mechanism. When the flush lever is engaged with the drainage mechanism, a flushing cycle of the toilet is initiated by a motion of the flush arm portion, and the flush arm portion is situated such that access to the flush arm portion is prohibited by the closure lid in the second position and permitted by the closure lid in the first position.

22 Claims, 3 Drawing Sheets

FLUSH LEVER ASSEMBLY THAT PREVENTS FLUSHING OF THE TOILET UNLESS THE SEAT AND LID ARE IN A LOWERED POSITION

BACKGROUND OF THE INVENTION

1. Field of the Invention

This invention relates to devices for preventing flushing of a toilet without the lid and seat first being in a lowered position. Specifically, it relates to a design for an improved flush lever which cannot be flushed when the toilet seat and lid are in the raised position.

2. Discussion of the Related Art

A particularly vexing problem relating to the standard household flush toilet relates to the fact that certain users of the toilet fail to close the lid, and therefore do not lower the seat, after using the toilet.

Closing of the toilet seat and lid when the toilet is not in use is the preferred practice for a number of reasons. For one thing, it helps to keep unwanted odors from emanating into the rest of the bathroom. Moreover, keeping the lid closed is important for reasons of safety. For example, small children may be tempted to play around an open toilet, which can lead to their exposure to extremely unsanitary surfaces of the bowl, and in the worst case, to their falling into the bowl with unthinkable consequences.

The seat and lid being left open is particularly annoying for women, who may, for example, in the middle of the night wrongly assume in a dark bathroom that the seat has been lowered only to find to their horror that it has not been.

Another annoying problem for users of toilet bowls is the fact that some males upon approaching a toilet with the lid up and the seat down will urinate without bothering to lift the seat. If the seat and lid are always both in the lowered position when the toilet is not in use, however, such persons would be likely to raise both the lid and seat when desiring to urinate since lifting both would require no additional effort.

Prior art devices which have heretofore set out to remedy this problem have mainly fallen into one of two categories: (a) automatic flushing systems, that is, devices by which the toilet is flushed in response to a lowering of the seat and/or lid; and (b) flush lever covers, which are attached to a part of the toilet, and which cover the entire flush lever when the lid and/or seat is in the raised position.

Several devices falling into category (a) will now be discussed. U.S. Pat. No. 1,803,958, issued to W. H. Cadwell et al. discloses a seat operated flush valve which causes a the toilet to flush by successive lowering and raising of the toilet seat. U.S. Pat. No. 4,974,263, issued to Mark Sheppard et al., discloses a lid actuated toilet flushing system. In this system, a conventional flushing flapper valve is actuated by a pull chain controlled by the positioning of the toilet lid. To flush the toilet, the lid must be moved from the raised to the lowered position. U.S. Pat. No. 5,400,446, issued to John. M. Bloemer et al., discloses a flushing mechanism which triggers a flush in response to the closing of the toilet lid. A magnet attached to the lid is detected by a sensor. Upon detection of the lowering of the lid, the sensor activates a battery powered motor which raises a flapper valve so as to flush the toilet.

Several devices falling into category (b) will now be discussed. U.S. Pat. No. 4,512,046, issued to Rita C. Riggle, discloses a spoonlike "toilet guard" which screws into the underside of the toilet lid and which projects outwardly from the toilet when the lid is closed, but which completely covers the flush handle of the toilet when the lid is raised. U.S. Pat. No. 4,519,105, issued to James R. Blanck, discloses a handle guard which attaches to the front of the toilet tank and which is spring loaded so as to swing away from the front of the tank when the lid is down but to be forced against the tank when the toilet lid is raised, thereby covering the flush handle with a cuplike portion provided at the end of the guard. As in the device disclosed in Riggle, the Blanck device completely covers the flush handle. U.S. Pat. No. 5,435,016, issued to Gregory S. Smith et al. discloses yet another toilet flush handle cover, operating on the same principle as Riggle and Blanck but affixed to the underside of the seat.

Although generally good for their intended applications, each of the above solutions has drawbacks. In the case of the devices in category (a), each and every time the lid and/or seat is lowered, the toilet is flushed, which may not always be desired. In addition, these devices generally require an extensive and complex retrofit of the toilet, or are only available as a manufactured toilet assembly.

Each of the devices in category (b) adds an aesthetically questionable protrusion from the side of the toilet. In addition, if the toilet guard should break off, being made of plastic, it could leave a sharp edge, endangering those who use the area around the toilet bowl. Furthermore, even unbroken, the protrusion of such a device can cause a tripping hazard, especially in the dark.

Yet another approach is disclosed in U.S. Pat. No. 4,839,928, issued to T. Probasco, which describes an automatic seat lowering device in which a wedge shaped extension is attached to a flush handle, and when the flush handle is depressed, the wedge engages the toilet seat forcing it to close. This device, however, while ensuring the lowering of the seat, does not cause the lid to be lowered, which is preferred for the reasons mentioned above.

SUMMARY OF THE INVENTION

In consideration of the above, it is an object of the present invention to provide a toilet flush handle assembly which forces a user of the toilet to lower both the lid and seat before the toilet can be flushed.

It is a further object of the invention to provide a toilet flush handle assembly of simple, aesthetically pleasing, design and construction, which does not require an extensive retrofit for it to be used on an existing toilet.

In consideration of the above and other objects, according to one aspect of the present invention, a flush lever assembly for use in a toilet having a main body, a seat, a closure lid movable between a first position in which the seat is covered and a second position in which the seat is not covered, and a drainage mechanism, comprises: a bolt for engaging the main body; and a flush lever having a flush arm portion and an insertion portion to be inserted into the bolt to lockingly engage the flush lever to the drainage mechanism. When the flush lever is engaged with the drainage mechanism, a flushing cycle of the toilet is initiated by a motion of the flush arm portion, and the flush arm portion is situated such that access to the flush arm portion is prohibited by the closure lid in the second position and permitted by the closure lid in the first position.

According to another aspect of the invention, a flush lever assembly for use in a toilet having a tank, a closure lid, a drainage mechanism, and a seat, comprises: (a) a collared bolt having: a collar open at least on a side oriented towards a center of a front of the tank, a head for engaging a hole in the front of the tank so that the collared bolt cannot rotate once the head is so engaged, and a threaded portion for inserting through the hole; (b) a threaded nut for engaging the threaded portion on an inside of the tank; and (c) a flush lever having: a cylindrical portion for inserting into the collared bolt, the cylindrical portion being structured to lockingly engage the drainage mechanism, a flush arm extending perpendicular to the cylindrical portion that when the flush lever is engaged with the drainage mechanism rests normally in a direction towards the center of the front of the tank. The flush lever normally rests with the flush arm on a lower portion of the collar oriented towards the center of the front of the tank, the flush arm being in a position such that the lid must be lowered for a user to access the flush lever. When the toilet is to be flushed, the flush lever is lifted upwardly to effect flushing of the toilet. The collar is preferably enclosed within a protective cover to prevent a user from flushing the toilet when the seat and lid are raised. The flush arm preferably has lifting means, protruding in a direction opposite of the cylindrical portion and located at an opposite end of the flush lever, of a dimension to facilitate lifting of the flush lever, or is tapered so as to become wider in a direction away from the cylindrical portion, the widening being of a dimension to facilitate lifting of the flush lever.

According to yet another aspect of the invention, a flush lever assembly for use in a toilet having a tank, a closure lid, a drainage mechanism, and a seat, comprises: (a) a bolt having: a head for engaging a hole in the front of the tank so that the bolt cannot rotate once the head is so engaged, and a threaded portion for inserting through the hole in the tank; (b) a collar-washer open at least on one side, the collar-washer having a centrally located hole for mating with the head of said bolt so that, when the collar-washer and the head are mated, the collar-washer cannot rotate with respect to the bolt and the opening of the collar-washer will be oriented towards a center of a front of the tank; (c) a threaded nut for engaging the threaded portion on an inside of the tank; and (d) a flush lever having: a cylindrical portion for inserting into said bolt, the cylindrical portion being structured to lockingly engage the drainage mechanism, a flush arm extending perpendicular to the cylindrical portion that when the flush lever is engaged with the drainage mechanism rests normally in a direction towards the center of the front of the tank. The flush lever normally rests with the flush arm on a lower portion of the collar-washer and oriented towards the center of the front of the tank, the flush arm being in a position such that the lid must be lowered for a user to access the flush lever. When the toilet is to be flushed, the flush arm is lifted upwardly to effect flushing of the toilet. The collar-washer is preferably enclosed within a protective cover to prevent a user from flushing the toilet when the seat and lid are raised. The flush arm preferably has lifting means, protruding in a direction opposite of the cylindrical portion and located at an opposite end of the flush lever, of a dimension to facilitate lifting of the flush lever, or is tapered so as to become wider in a direction away from the cylindrical portion, the widening being of a dimension to facilitate lifting of the flush lever.

DETAILED DESCRIPTION OF THE PREFERRED EMBODIMENT

Figures 1, 2:
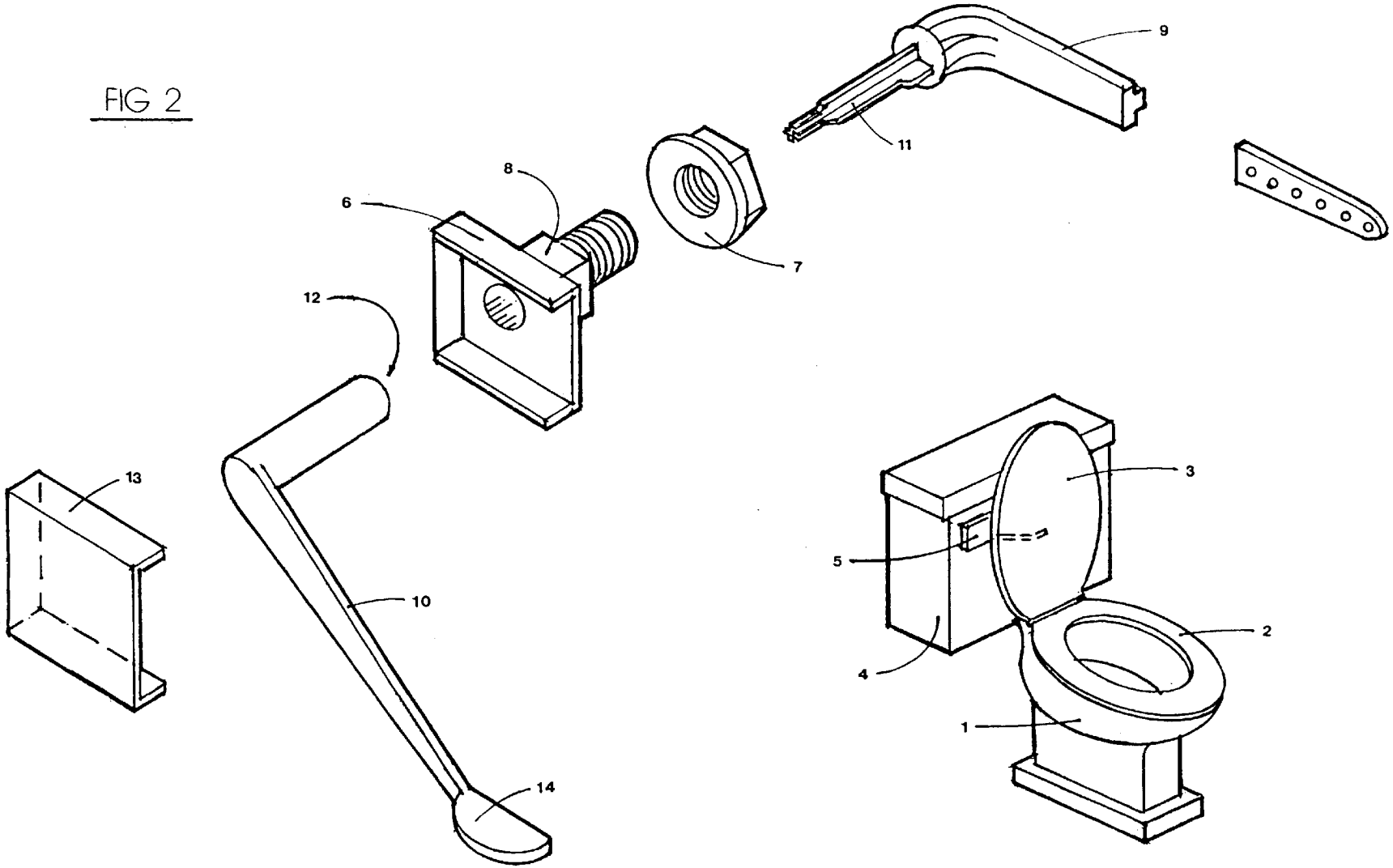
FIG. 1 is a perspective view of a toilet employing the flush lever of the present invention.
FIG. 2 is an exploded view of the flush lever assembly according to a first embodiment of the present invention.

FIG. 1 shows a conventional toilet having a toilet bowl 1, a pivotally mounted toilet seat 2, a closure lid 3, a tank (main body) 4 and the flush lever assembly 5 of the present invention.

FIG. 2 illustrates the first embodiment of the flush lever assembly 5. As shown in FIG. 2, a collared bolt 6 is mounted to the front wall of the tank 4 with a threaded nut 7. The collared bolt 6 is inserted through a hole in the tank wall so that the open side of the collar is oriented to the center of the tank. The square head 8 of the bolt maintains this relationship by preventing the bolt from rotating once it is engaged to the tank wall. A lift arm 9, constituting a part of the drainage mechanism of the toilet, and flush lever 10 are inserted through the hole in the nut 7 and bolt 6, respectively. They are lockingly engaged by inserting the keyed shaft 11 of the lift arm into the corresponding keyed slot 12 of the flush lever. A cover plate 13 is then placed over the collar with the open side oriented to the center of the tank, as with the collared bolt 6.

In this configuration, the flush lever rests on a lower portion of the collar in a downward and to the right attitude. Also, in this position, the lift tab 14 lies between the raised closure lid 3 and the tank 4.

Operation of the Preferred Embodiment

The desired flush cycle begins with the seat and lid in the closed position. As a user approaches, he/she lifts the lid, or lid and seat, as required and uses the toilet. It is assumed that a man who approaches with intent to urinate while standing will lift both the lid and the seat simultaneously, as it requires no additional effort. After use, he/she is forced to lower the lid, or lid and seat, to gain access to the flush lever. The collar and cover plate prevent would-be deviants from operating the flush lever unless both the lid and seat are down. Once lowered to again reside in the safe, hygienic position, the flush lever is raised, the toilet is flushed, and the cycle is complete.

Figure 3:
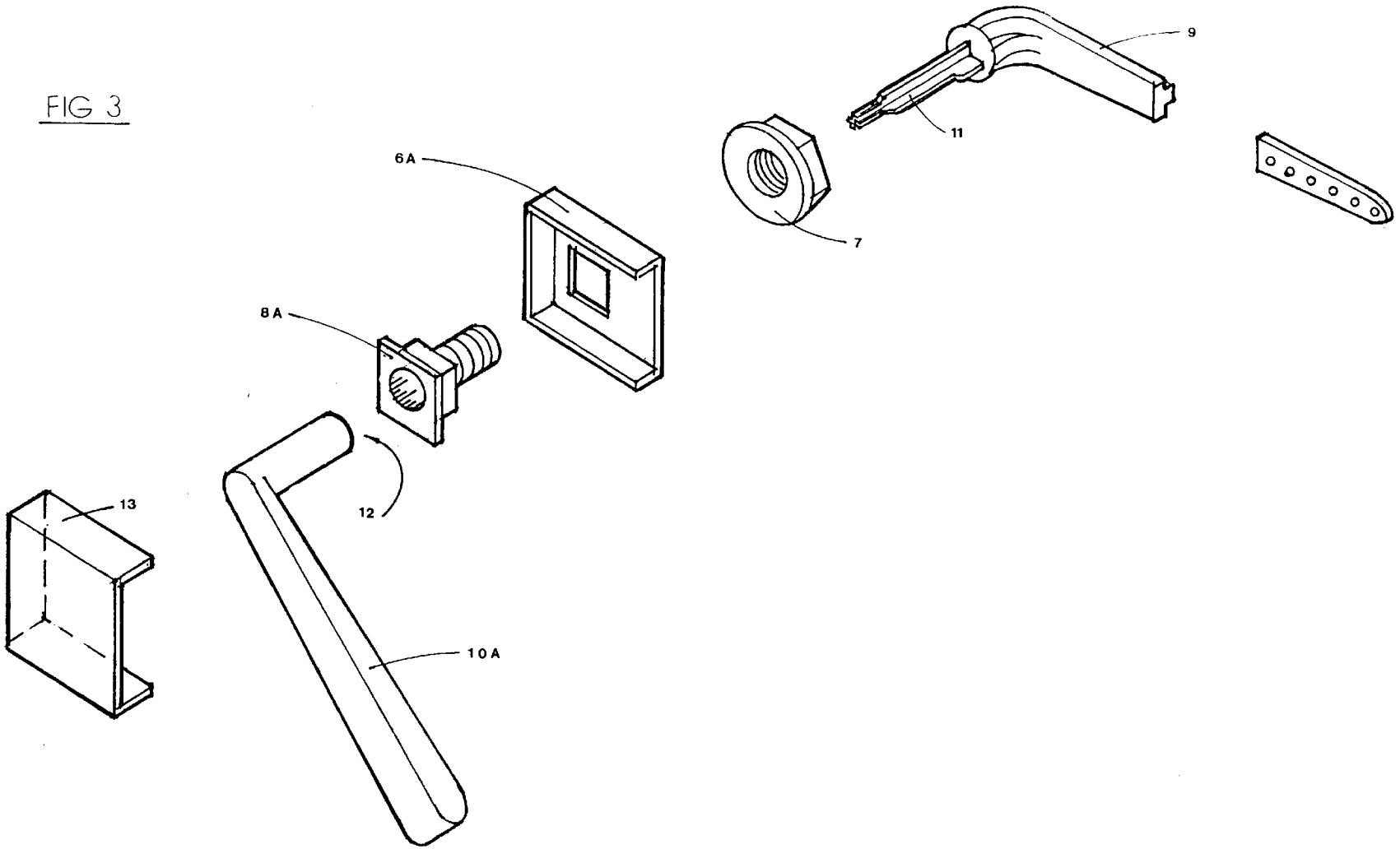
FIG. 3 is an exploded view of the flush lever assembly according to a second embodiment of the present invention.

FIG. 3 illustrates a second embodiment of the flush lever assembly. In FIG. 3, components which are the same as corresponding components in FIG. 2 are assigned identical reference numerals.

In the flush lever assembly of the second embodiment, rather than utilize a collared bolt, a square headed bolt with a flange 8A is used in combination with a collared washer 6A having a square hole so that then the bolt 8A is mated with the washer 6A, the washer 6A and the bolt 8A maintain their mutual rotational orientation. When mated, washer 6A and 8A perform the same function as the collared bolt of the previous embodiment. Although flange 8A is shown in FIG. 3 as square, it may be round or of any shape which prevents the bolt from going through the hole in the tank.

Also, in this embodiment, flush lever 10A, rather than having a lift tab, is formed such the lever tapers gradually, becoming thicker at the end to allow for lifting of the flush lever by its thicker end.

The functions of the other components shown in FIG. 3 are essentially identical to the functions of corresponding components in the previous embodiment and the description of these functions will not be repeated. Operation of a toilet employing the flush lever assembly of the second embodiment is the same as the operation of the previous embodiment.

Figure 4:
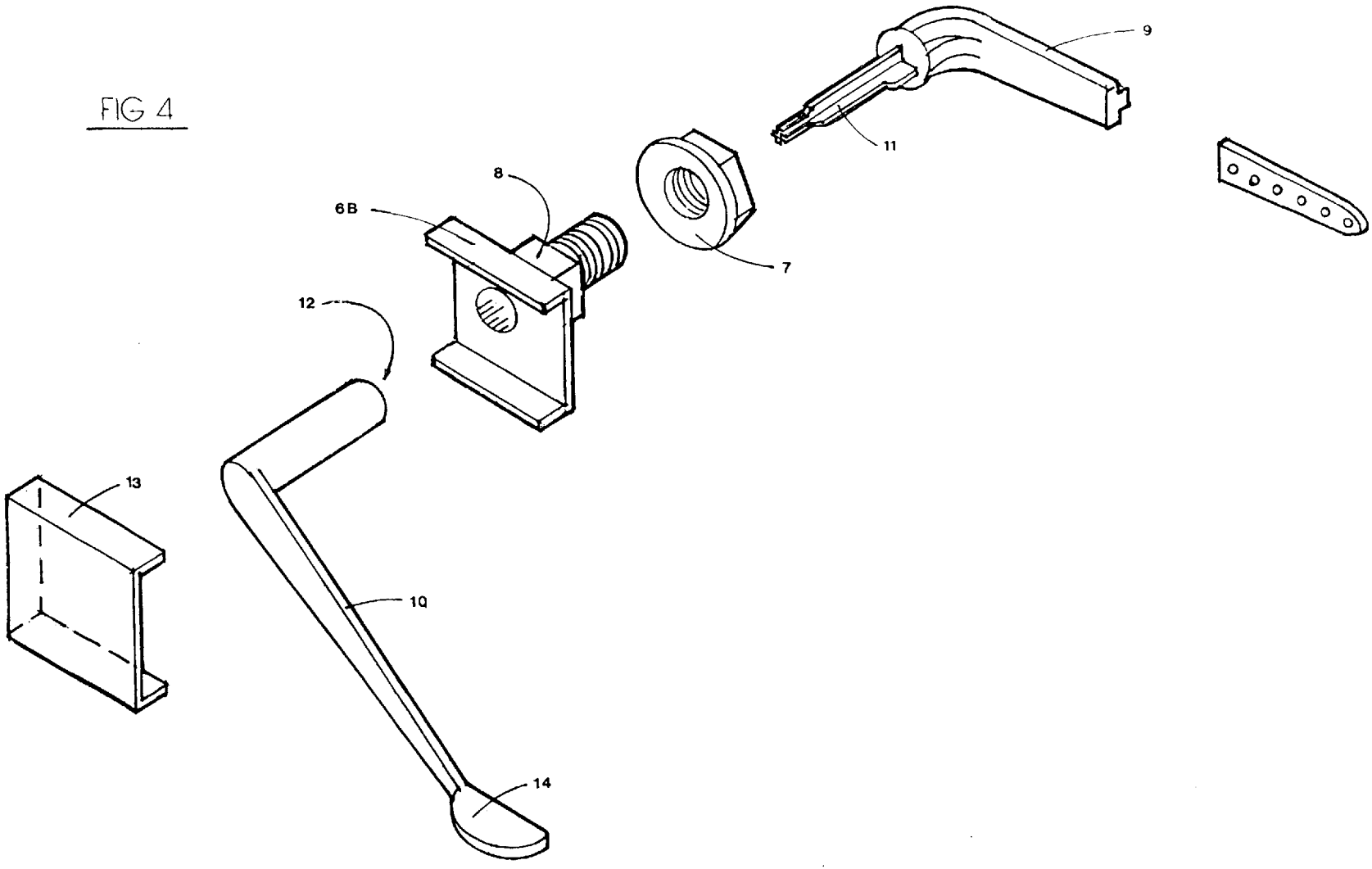
FIG. 4 is an exploded view of the flush lever assembly according to a third embodiment of the present invention.

FIG. 4 illustrates a third embodiment of the present invention. In FIG. 4, components which are the same as corresponding components of FIG. 2 are assigned identical reference numerals.

In the third embodiment, the collar 6B, rather than be open on only one side, is open on two sides. Just as in the first two embodiments, cover plate 13 fits over collar 6B with the opening facing towards the center of the front of the tank to prevent the user from flushing the toilet when the lid is raised. The invention of the third embodiment functions essentially identically to the first embodiment and those functions will not be repeated.

It is understood that the above description and drawings are illustrative of the present invention and detail contained therein are not to be construed as limitations on the present invention. For example, for contoured or faceted tanks, the flush lever can be shaped to accommodate this relationship. For another example, the tapered flush lever of the second embodiment may be utilized with the collared bolt of the first embodiment. Moreover, the head of the bolt may be of any shape which would prevent rotation of the bolt when the bolt is engaged with the hole in the front of the tank. In addition, the collared washer of the second embodiment may be open on more than one side, as is the collared bolt of the third embodiment. The device may also be used in a toilet in which the bowl and seat are integrally formed and in which a seat portion of the seat-bowl assembly is covered by a lid in a first position and not covered when the lid is in a second position. Further, the keying which lockingly engages the flush arm with the lift arm of the drainage mechanism of the toilet may be of any configuration which allows for such locking engagement. For example, a polygonal keying, such as a hex key arrangement, can be substituted for the slotted keying shown in the figures. Moreover, the flush lever assembly can be oriented for use on the right side of the front of the tank, for toilets having a hole in that location. In such a case, the flush lever would, in the preferred embodiment, normally be oriented diagonally down and to the left, from the perspective of someone facing the toilet.

Changes in components, procedure and structure may be made without departing from the scope of the present invention as defined in the following claims.

What is claimed is:

1. A flush lever assembly for use in a toilet having a main body having a hole therein, a bowl, a closure lid movable between a first position in which the bowl is covered and a second position in which the bowl is not covered, and a drainage mechanism, said flush lever assembly comprising:

a bolt for engaging the main body through the hole; and a flush lever having a flush arm portion and an insertion portion to be inserted into said bolt to lockingly engage said flush lever to the drainage mechanism, wherein when said flush lever is engaged with the drainage mechanism, a flushing cycle of the toilet is initiated by a motion of said flush arm portion, and said flush lever normally rests with the flush arm portion behind the closure lid when the closure lid is in the second position such that the closure lid must be lowered to the first position for a user to operate the flush lever, wherein said bolt has a collar having a gap therein, said gap being oriented towards the center of a front of the main body, said collar adapted to be located on the front face of the main body, said bolt further having a threaded portion for inserting through the hole in the front of the main body.

2. A flush lever assembly according to claim 1, said flush lever assembly further comprising a threaded nut for engaging the threaded portion on an inside of the main body.

3. A flush lever assembly according to claim 2, said bolt further having a head for engaging the hole in the front of the main body so that the bolt cannot rotate once the head is so engaged.

4. A flush lever assembly according to claim 1, wherein the insertion portion is keyed to lockingly engage said flush lever to the drainage mechanism, and the flush arm portion normally rests against a lower edge of the collar, a flushing cycle being initiated by an upward motion of the flush arm portion.

5. A flush lever assembly according to claim 1, further comprising a cover plate for placement over the collar, said cover plate having an open side which corresponds with said gap when said cover is placed on the collar to allow a flushing movement of said flush lever and to further prevent the user from operating said flush lever while the lid is in the second position.

6. A flush lever assembly according to claim 1, wherein the bowl has a seat integrally formed therewith.

7. A flush lever assembly according to claim 1, the toilet further having a seat movable between a raised position and a lowered position in which it rests on top of the bowl.

8. A flush lever assembly for use in a toilet having a tank, a closure lid, a drainage mechanism, and a seat, the tank having an inside and a front, and the front having a center, said flush lever assembly comprising:

(a) a collared bolt having:

a head for engaging a hole in the front of the tank so that the collared bolt cannot rotate once the head is so engaged, a collar surrounding said head and having a gap therein, said gap being oriented on said collar to face towards the center of the front of the tank when said collared bolt is engaged therewith, and a threaded portion for inserting through the hole;

(b) a threaded nut for engaging the threaded portion on the inside of the tank; and (c) a flush lever having:

a cylindrical portion for inserting into the collared bolt, the cylindrical portion being structured to lockingly engage the drainage mechanism, a flush arm extending perpendicular to the cylindrical portion such that when the flush lever is engaged with the drainage mechanism said flush arm rests normally in a direction pointing towards the center of the front of the tank, wherein the flush lever normally rests with the flush arm against a lower edge of the gap oriented towards the center of the front of the tank and behind said lid when said lid is in a raised position, such that the lid must be lowered for a user to operate the flush lever, and wherein, when the toilet is to be flushed, said flush lever is lifted upwardly to effect flushing of the toilet.

9. A flush lever assembly according to claim 8, wherein said flush arm has lifting means of a dimension to facilitate lifting of the flush lever.

10. A flush lever assembly according to claim 8, wherein said flush arm is tapered so as to facilitate lifting of the flush lever.

11. A flush lever assembly according to claim 8, further comprising a cover plate for placement over the collar, said cover plate having an open side which corresponds with said gap when said cover plate is placed on said collar to allow a flushing movement of said flush lever and to further prevent the user from operating said flush lever while the lid is in the raised position.

12. A flush lever assembly for use in a toilet having a tank, a closure lid, a drainage mechanism, and a seat, the tank having an inside and a front, and the front having a center, said flush lever assembly comprising:

(a) a bolt having:

a head for engaging a hole in the front of the tank so that the bolt cannot rotate once the head is so engaged, and a threaded portion for inserting through the hole in the tank;

(b) a collar-washer having a gap in a collar portion thereof, said collar-washer having a centrally located hole for mating with the head of said bolt so that, when said collar-washer and the head are mated, the collar-washer cannot rotate with respect to said bolt and the gap in the collar-washer will be oriented towards the center of the front of the tank;

(c) a threaded nut for engaging the threaded portion on the inside of the tank; and (d) a flush lever having:

a cylindrical portion for inserting into said bolt, the cylindrical portion being structured to lockingly engage the drainage mechanism, a flush arm extending perpendicular to the cylindrical portion such that when the flush lever is engaged with the drainage mechanism, said flush lever rests normally in a direction pointing towards the center of the front of the tank, wherein said flush lever normally rests with said flush arm against a lower edge of said gap oriented towards the center of the front of the tank, and behind said lid when said lid is in a raised position, such that the lid must be lowered for a user to operate the flush lever, and wherein when the toilet is to be flushed, said flush arm is lifted upwardly to effect flushing of the toilet.

13. A flush lever assembly according to claim 12, wherein said flush arm has lifting means of a dimension to facilitate lifting of the flush lever.

14. A flush lever assembly according to claim 12, wherein said flush arm is tapered so as to facilitate lifting of the flush lever.

15. A flush lever assembly according to claim 12, further comprising a cover plate for placement over the collar-washer, said cover plate having an open side which corresponds with said gap when said cover plate is placed on said collar-washer to allow a flushing movement of said flush lever and to further prevent the user from operating said flush lever while the lid is in the raised position.

16. A replacement flush lever assembly for retrofitting a toilet having a main body having a preexisting hole therein, a bowl, a closure lid movable between a first position in which the bowl is covered and a second position in which the bowl is not covered, and a drainage mechanism, the preexisting hole being situated such that it is not behind the lid in the second position, said flush lever assembly comprising:

a bolt for engaging the main body through the hole; and a flush lever having a flush arm portion and an insertion portion to be inserted into said bolt to lockingly engage said flush lever to the drainage mechanism, wherein when said flush lever is engaged with the drainage mechanism, a flushing cycle of the toilet is initiated by a motion of said flush arm portion, and said flush arm lever normally rests with the flush arm portion behind the closure lid when the closure lid is in the second position such that the closure lid must be lowered to the first position for a user to operate the flush lever, wherein said bolt has a collar having a gap therein, said gap being oriented towards the center of a front of the main body, said collar adapted to be located on the front face of the main body, said bolt further having a threaded portion for inserting through the hole in the front of the main body.

17. A flush lever assembly according to claim 16, said flush lever assembly further comprising a threaded nut for engaging the threaded portion on an inside of the main body.

18. A flush lever assembly according to claim 17, said bolt further having a head for engaging the hole in the front of the main body so that the bolt cannot rotate once the head is so engaged.

19. A flush lever assembly according to claim 16, wherein the insertion portion is keyed to lockingly engage said flush lever to the drainage mechanism, and the flush arm portion normally rests against a lower edge of the collar, a flushing cycle being initiated by an upward motion of the flush arm portion.

20. A flush lever assembly according to claim 16, further comprising a cover plate for placement over the collar, said cover plate having an open side which corresponds with said gap when said cover is placed on the collar to allow a flushing movement of said flush lever and to further prevent the user from operating said flush lever while the lid is in the second position.

21. A flush lever assembly according to claim 16, wherein the bowl has a seat integrally formed therewith.

22. A flush lever assembly according to claim 16, the toilet further having a seat movable between a raised position and a lowered position in which it rests on top of the bowl.

* * * * *